US010500422B2

(12) United States Patent
Messner

(10) Patent No.: US 10,500,422 B2
(45) Date of Patent: Dec. 10, 2019

(54) INTEGRATED UMBILICAL DELIVERY SYSTEM FOR GAS, DATA, COMMUNICATIONS ACQUISITION/DOCUMENTATION, ACCESSORY POWER AND SAFETY FOR USERS IN ADVERSE ENVIRONMENTS

(71) Applicant: William Messner, Forest Park, IL (US)

(72) Inventor: William Messner, Forest Park, IL (US)

( * ) Notice: Subject to any disclaimer, the term of this patent is extended or adjusted under 35 U.S.C. 154(b) by 28 days.

(21) Appl. No.: 15/039,346

(22) PCT Filed: Dec. 23, 2014

(86) PCT No.: PCT/US2014/072009

§ 371 (c)(1),
(2) Date: May 25, 2016

(87) PCT Pub. No.: WO2015/100274

PCT Pub. Date: Jul. 2, 2015

(65) Prior Publication Data

US 2017/0173368 A1 Jun. 22, 2017

Related U.S. Application Data

(60) Provisional application No. 61/920,670, filed on Dec. 24, 2013, provisional application No. 61/946,854, (Continued)

(51) Int. Cl.
*A62B 7/00* (2006.01)
*A62B 7/12* (2006.01)
(Continued)

(52) U.S. Cl.
CPC ..... *A62B 7/12* (2013.01); *A62B 9/02* (2013.01); *A62B 35/0043* (2013.01);
(Continued)

(58) Field of Classification Search
CPC ..... B63C 11/02; B63C 11/20; B63C 11/202; B63C 2011/021; A62B 7/00; A62B 7/12; A62B 9/02; A62B 9/022
(Continued)

(56) References Cited

U.S. PATENT DOCUMENTS 3,524,444 A * 8/1970 Ellard ..... B63C 11/24 128/201.27
3,924,619 A * 12/1975 Banjavich ..... B63C 11/24 128/204.17
(Continued)

FOREIGN PATENT DOCUMENTS

JP 3568268 B2 * 9/2004
WO WO 9205999 A1 * 4/1992 ..... B63C 11/18
WO WO 2013064962 A2 * 5/2013 ..... F16K 11/085

*Primary Examiner* — Justine R Yu
*Assistant Examiner* — Douglas Y Sul

(57) ABSTRACT

A system for delivering multiple life-support services within a flexible protective covering, a plurality of different breathing gasses, safety tether, a plurality of ancillary lines for documentable, multidirectional, multi-format data/communications acquisition and delivery, personal/situational awareness and ancillary power sources for tool, accessory or device enervation, to a plurality of Users in an adverse environment.

7 Claims, 1 Drawing Sheet

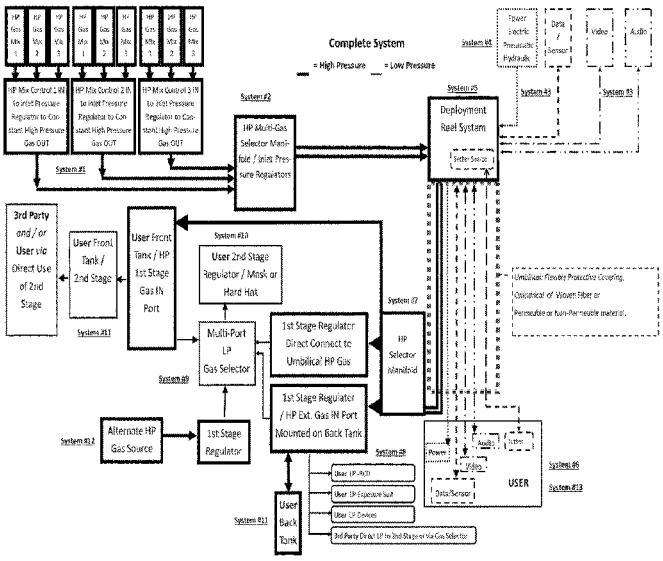

Related U.S. Application Data filed on Mar. 2, 2014, provisional application No. 62/093,866, filed on Dec. 18, 2014.

(51) Int. Cl.

| | |
|---|---|
| ***B63C 11/20*** | (2006.01) |
| ***A62B 99/00*** | (2009.01) |
| ***B63C 11/08*** | (2006.01) |
| ***A62B 9/02*** | (2006.01) |
| ***A62B 35/00*** | (2006.01) |

(52) U.S. Cl.
CPC ..... *A62B 99/00* (2013.01); *B63C 11/08* (2013.01); *B63C 11/20* (2013.01)

(58) Field of Classification Search
USPC ..... 405/185, 86, 190, 191; 114/314
See application file for complete search history.

(56) References Cited

U.S. PATENT DOCUMENTS 4,026,283 A * 5/1977 Banjavich ..... B63C 11/24 128/201.27
4,138,178 A * 2/1979 Miller ..... H01R 13/523 138/115
4,196,307 A * 4/1980 Moore ..... H01B 7/0072 174/116
4,808,767 A * 2/1989 Colbachini ..... B63C 11/18 128/201.27
5,070,437 A * 12/1991 Roberts, Sr. ..... A01K 85/01 362/158
5,508,736 A * 4/1996 Cooper ..... G08B 5/36 348/144
5,529,096 A * 6/1996 Rowe, Jr. ..... A62B 9/02 128/202.13
5,678,542 A * 10/1997 Maffatone ..... B63C 11/32 128/201.27
5,707,177 A * 1/1998 Lehrer ..... B63C 11/08 405/186
5,906,200 A * 5/1999 Kaburaki ..... B63B 27/146 128/201.12
6,292,213 B1 * 9/2001 Jones ..... G06Q 10/087 224/181
6,390,640 B1 * 5/2002 Wong ..... B63C 11/12 351/148
7,823,609 B2 * 11/2010 Wonders ..... F17C 5/06 141/18
2007/0039617 A1 * 2/2007 Buhlmann ..... B63C 11/18 128/201.28
2010/0288801 A1 * 11/2010 Messner ..... A45F 5/02 224/101
2011/0102177 A1 * 5/2011 Johnson ..... H04B 11/00 340/540
2011/0297153 A1 * 12/2011 Grimsey ..... B63C 11/24 128/204.18

* cited by examiner

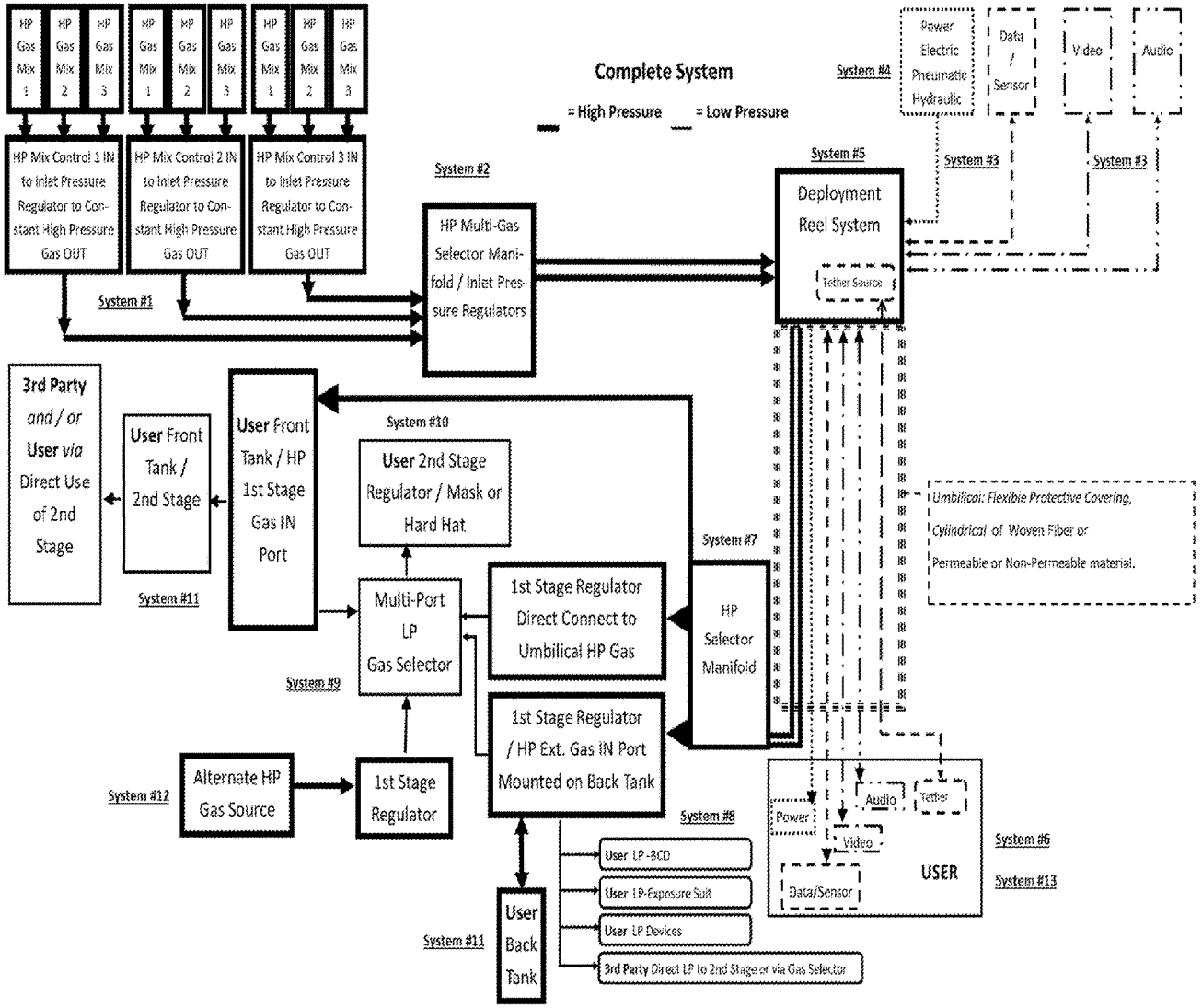
Complete System
= High Pressure
= Low Pressure
System #1
System #2
System #3
System #4
System #5
System #6
System #7
System #8
System #9
System #10
System #11
System #12
System #13
HP Gas Mix 1
HP Gas Mix 2
HP Gas Mix 3
HP Mix Control 1 IN to Inlet Pressure Regulator to Constant High Pressure Gas OUT
HP Mix Control 2 IN to Inlet Pressure Regulator to Constant High Pressure Gas OUT
HP Mix Control 3 IN to Inlet Pressure Regulator to Constant High Pressure Gas OUT
HP Multi-Gas Selector Manifold / Inlet Pressure Regulators
Power
Electric
Pneumatic
Hydraulic
Data / Sensor
Video
Audio
Deployment Reel System
Tether Source
Umbilical: Flexible Protective Covering,
Cylindrical of Woven Fiber or
Permeable or Non-Permeable material.
USER
Power
Data/Sensor
Video
Audio
Tether
HP Selector Manifold
1st Stage Regulator Direct Connect to Umbilical HP Gas
1st Stage Regulator / HP Ext. Gas IN Port Mounted on Back Tank
User LP-SCD
User LP-Exposure Suit
User LP Devices
3rd Party Direct LP to 2nd Stage or via Gas Selector
User Back Tank
User 2nd Stage Regulator / Mask or Hard Hat
Multi-Port LP Gas Selector
1st Stage Regulator
Alternate HP Gas Source
User Front Tank / HP 1st Stage Gas IN Port
User Front Tank / 2nd Stage
3rd Party and / or User via Direct Use of 2nd Stage

INTEGRATED UMBILICAL DELIVERY SYSTEM FOR GAS, DATA, COMMUNICATIONS ACQUISITION/DOCUMENTATION, ACCESSORY POWER AND SAFETY FOR USERS IN ADVERSE ENVIRONMENTS

CROSS-REFERENCE RELATED APPLICATIONS

This Application claims the benefit of provisional patent applications:

No. 61/920,670, Dated Dec. 24, 2013
No. 61/946,854, Dated Mar. 2, 2014
No. 62/093,866. Dated Dec. 18, 2014

FEDERALLY SPONSORED RESEARCH

None

SEQUENCE LISTING

None

BACKGROUND

Field of Invention

This invention relates to the combined, redundant and replenish-able delivery of breathing gases, energy sources, and documental systems for multidirectional, multi-format communications and data acquisition, plus safety tether to one or more Users operating in adverse environments.

Prior Art

This invention relates to the combined, redundant and replenish-able delivery of energy sources, communications, situational and personal diagnostics, safety tether and breathing gas to one or more Users operating in adverse environments. By example, this invention may be used by Users operating in extreme environments ("Responders" or "Users") wherein communications, power sources, systems for monitoring vital human statistics and situational awareness, and for delivering breathing gases that are combined with the safety tether, and a replenish-able redundant gas supply, for both breathing and ancillary applications, in a single, flexible umbilical system, the supply for which, originates with a remotely positioned operator ("Operators"). This may include umbilical delivery to underwater divers (SCUBA) as well as terrestrial users (SCBA) such as first responder firefighters, confined space, and hazmat specialists.

Both terrestrial and sub-aquatic systems have evolved into "full face mask" designs that, along with the containment suits worn by the User/Responders, fully encapsulate them from the adverse environments in which they work. These masks cover the entire face. They allow the User/Responder to breathe uncontaminated gas and communicate with a remote Operator.

Communications are facilitated by systems that allow bidirectional Audio/Visual communications. Audio communication facilitated within the full face mask ("FFM") into which User/Responders may speak to the remote operators or other User/Responders, who are heard in return through an ear piece.

Visual communications are facilitated by "camera/sensors," operating in any suitable frequency spectrum (i.e. visual light, infrared, sonar), which deliver signals through the umbilical system to the Operator. If the camera/sensors operates outside of the visual spectrum, the data may then converted to the visual spectrum for real time monitoring, recordation and redelivery to the User/Responder via an integrated display.

Energy sources may power illumination for both immediate and distant work areas of the User/Responder, and or to power the camera/sensors for Operator viewing, recordation and or redistribution. They also may power (by way of example only), additional User/Responder accessories, such as accessory tools and heating elements within undergarments worn by the User/Responder thermal, environmental protection, power, tether and gas supplies.

The tether line attaches the User/Responder's harness system directly to the safety area, (either surface or underwater.) for safety or as a "hand signaling" device, for communicating with the Operator, in the event of electronic communication failure. The harness system may also retain an independent, back up, redundant, breathing gas supply in the event of primary gas delivery system failure. The backup gas system may not only service the needs of the needs of the User/Responder, it may also service the breathing gas needs of a "victim" ("Rescuee") in the event of a rescue, or the needs of a third-party User/Responder, not directly connected to the umbilical system.

While each of the separate systems described above exist in the market place, they have not been combined into a single, fully integrated, light weight, easily transportable system. The instant invention accomplishes not only that, but adds features, operational options and possibilities in the event of an emergency, never before contemplated.

Multiplicity of Design Elements

Design Element 1:

By grouping separately, non-interconnected lines (tether, gas, communications, diagnostics, data and power) together within a flexible shield, each line serves its function only. The tensile strength needed to hoist an extremely heavy UW/User/Responder to safety, fully equipped, possibly with water-filled exposure suit, or a terrestrial responder with rescuee comes entirely from the safety tether. With that as its only task, the design requires a light weight, highly flexible line, with extreme linear strength. As a result, gas, communications, data or power delivery lines need be designed only for their optimal, singular functions. The invention allows these independent functions, by separately terminating each line (the tether being the shortest) at both the diver and deployment reel. Lifting capacity is carried by the tether only.

Independently of the tether, the power, communications, data and gas lines may slide freely alongside each other within the flexible, protective sheath that bundles all lines together within the umbilical. This design achieves maximum flexibility in function and eliminates the possibility of damage (and functional loss) of their respective points of termination.

Similarly, the communication and diagnostic lines, may be made of either small diameter, optical cables, or highly flexible, stranded wires, with coverings appropriate to temperatures changes and interference rejections. In similar fashion, power lines for accessories, tools or illumination are limited to their specific requirements. Equally important, the gas line design parameters are limited to delivering high-pressure gas, in cold, wet environments, with maximum flexibility.

Design Element 2: Primary Supply of Breathing Gas.

The umbilical system may deliver a breathing gas supply. Changes in environmental pressure generally do not occur, where this system is used on the surface (SCBA). However, when used underwater (SCUBA), rapid pressure changes occur within short distances or increased/decreased depth. These changes adversely affect the User/Responder's demand for breathing gas. The deeper the User descends, the more gas is required, compared to the surface. For example: at 33 feet, the User/Responder requires twice as much gas within each breath. At 99 feet, he requires four times as much. The additional gas is required to counterbalance the increased pressure of the water against the air cavities within his body. It therefore is necessary for the components of the umbilical system to adjust and adapt in real time to the User/Responder's demands for gas. Said pressure changes may not affect communication/diagnostic lines, power lines or tether strength.

To resolve the breathing gas related issues, a multiple stage system of reducing a constantly varying high-pressure gas source, down to a constantly varying low-pressure needed by the User/Responder, is required. The User/Responder, commonly employs a "first stage" (or intermediary stage) which reduces the gas from the high-pressure of a supply tank or compressor to a nominal level that is approximately (150 psi) above the ambient pressure of the environment (depth) at which the User/Responder is located. A Second Stage is incorporated (commonly within the full face mask worn by the User/Responder), which further reduces the gas pressure to a suitable level for natural breathing.

There are two possible locations for the first stage: either before the umbilical system at the source, or at the end of the umbilical line, with the User/Responder. In systems where the first stage is located at the source, the gas pressure delivered through the gas line to the second stage is "Low-pressure." The advantage of this system, it is simple and basic.

The multiplicity of disadvantages of this system are:

- it requires a dedicated surface operator with the appropriate equipment, to constantly monitor the depth and adjust the pressure being delivered through the gas line. For proper adjustment, the operator must maintain communications with the UW/User/Responder, know his depth and commensurately adjust the source output pressure to exceed the ambient pressure of the User/Responder. If the remotely operated pressure is too low, the second stage (located at the UW/User/Responder) will not deliver the required gas. If excessive, the second stage of the will free-flow (continuously expel air, uncontrollably). If the remotely operated pressure falls below what his depth requires, the UW/User/Responder will experience increased difficulty breathing. Insufficient air will be delivered to the UW/User/Responder.
- Because the internal pressure of the hose is low, it requires a very large diameter to allow sufficient gas flow to the diver. Large diameter hoses are large, bulky, heavy, cumbersome, and require an equally large system for deployment. Said bulk bars the use of multiple gas lines (for multiple gas delivery options), and greatly inhibits the ability to integrate additional lines for A/V communications, data, safety, and power for accessories.

Where the first stage is located with the UW/User/Responder, at his operational end of the umbilical, the regulation of the gas supply to the second stage is automatic. The advantages are many:

- the full high-pressure range of the gas supply of the Source is deliverable to the UW/User/Responder;
- the high-pressure provides sufficient gas flow, through a lightweight gas line with a cross-sectional diameter that is 80% smaller (and even greater percentage lighter), compared to "low-pressure" systems.
- systems required for gas line deployment are commensurately reduced in size, weight, complexity. Their "ease of use" is commensurately increased.
- allows for the easy inter-umbilical integration of multi-directional communications, data, accessory power and safety tether.
- it does not require a dedicated operator for continual operator monitoring and adjustment, based upon constant knowledge of the depth of the User/Responder
- multiple "Users" (including Rescuees) may breathe from the same high-pressure source, as described hereinabove and below.

Current "high-pressure" designs subject the line to the extreme variations in the internal pressures of the gas source. That variance can span as much as 3,700 psi, or more. This would occur where the starting pressure of the source gas is about 4,500 psi (or higher) and then drops to 800 psi or lower, as the gas is consumed. This extreme variation repeatedly stresses the entire system, with every insertion of a new (full) gas source following the depleted prior source. This system stress exists from source, to the $1^{st}$ stage regulator at the diver. This variation also limits the safety factor to approximately 3:1 (5,000 psi:15:000 psi).

To overcome this limitation, and simultaneously; a) triple safety factor (from 3:1 to 9:1): and b) concurrently reduce by 66% the stress levels on the entire system, the instant invention employs a "Inlet Pressure Regulator", ("IPR") to reduce the IN variable source pressure to a stable—user dial-able OUT pressure. This normally will be set at 1500 psi. At that pressure the margin of safety (and reduced wear) on the entire system is substantially increased, (from 3:1 to 9:1): This pressure is delivered to the $1^{st}$ stage regulator, located at the User/Responder.

Design Element 3: Breathing Gas Redundancy.

Users operating in extreme environments require redundancy for all systems, to assure maximum safety. To facilitate the goal, the instant invention provides additional safety systems to overcome possible failures in a variety of circumstances, including dual redundancy. In the event of interruption of the surface gas supply, the integrated multi-port gas block allows selection of multiple alternative sources. The first redundant source, is the one commonly carried on the User/Responder's back. Typically, this tank will carry the gas needed to service their Buoyancy Control Device ("BCD"), and their exposure suit ("dry suit"). In the event of surface supply failure, the gas block can select the "back tank" source, for the first layer of redundancy. In the event that supply fails or is exhausted, the gas block may select the "front" tank (i.e. "Pony Bottle"). In the event source should fail or be exhausted (in the event of diver entrapment), the quick connector leading from the back tank, can be disconnected, for insertion of alternative "external" gas supplies. Or alternatively, if the gas block supports greater number of gas IN ports, these may selected, with alternate sources being rotated IN as long as is necessary to free the UWResponder.

Gas redundancy is also provided by the "Pony Bottle". Because this layer of redundancy, is small and offers limited time underwater, it is important this alternate source always be full. To facilitate this assurance, the instant design provides for a "High-pressure" re-filling of the Pony Bottle "in situ". If for any reason, the Pony Bottle pressure drops below the optimal "3,000 psi", the surface Inlet Pressure Regulator (IPR) can be "opened up" by the operator, to increase downstream gas line pressure to 3,000 psi. This action will overcome a "check valve" within the filling port of an integrated $1^{st}$ stage tank valve/regulator, and allow the Pony Bottle to be refilled from the high-pressure surface supply—while the diver is underwater. Once filled, the surface operator will return the IPR to the nominal 1,500 psi operating. In the process, the Pony Bottle HP Gas IN check valve will close—with the Pony Bottle remaining fully charged.

This process for refilling air redundancy is identically applicable to the "back tank," as well as any redundancy tank used by terrestrial (SCBA) responders, as described hereinabove and below.

Design Element 4: Third-Party Access to Surface Supply.

This same design (refilling the Pony Bottle, in situ) also provides for an unlimited supply of gas to a third-party, who was not originally connected. This party's access to the surface supply comes through the $2^{nd}$ stage regulator attached to the Pony Bottle. As this tank is depleted it is repeatedly replenish the Pony Bottle, from the surface supply. These applications may include Scuba divers who adopt the surface supply system for extend "technical" dives. These dives may include penetration dives into wrecks. If another diver has a gas emergency requiring access, the surface supplied diver, can "share his surface supply." through the second stage of the "pony bottle" or the low-pressure OUT port of the "back tank", as well as any redundancy tank, any of which can be repeatedly refilled from the surface supply, as described hereinabove. This process for sharing a surface supply is identically applicable when used by terrestrial (SCBA) responders, as described hereinabove and below.

With the addition of multiple "low-pressure ports" to the $1^{st}$ stage regulator, interfacing the User/Responder with the surface supply, the user can simultaneously feed gas to the Buoyancy Control Device (BCD), the Users' "dry" exposure suit as well as third-party rescuees, as described hereinabove and below.

Design Element 5: Gas Line Multiplicity:

The High-pressure gas line of the instant design, being 20-25% the size of a comparable "Low-pressure," system, offers the opportunity to deliver multiple, selectable lines with different mixtures of breathing gas. With the addition of a gas selector manifold, on the High-pressure side of the $1^{st}$ stage regulator, feeding the Gas Block, one of a multiple number of gas lines may be selected. The gas selector manifold may be located at either the Operator or User end of the umbilical line.

The benefit of multiple gas sources for "commercial" and or "technical divers" is well established. Different mixtures of oxygen, nitrogen and helium are used to greatly increase the diver's operational depth and duration. Similarly, by changing gas mixtures on ascent, the time needed for "decompression" can be substantially reduced.

Design Element 6: Multi-Format Communications.

Umbilical systems are commonly used where environmental conditions are problematic/hazardous. Audio Communications between multiple User/Responders and surface Operator is essential for safe, efficient work in adverse environmental conditions. UW/User/Responders using Full Face Masks ["FFM's"] can communicate diver (User/Responder) to diver (User/Responder) and diver (User/Responder) to surface.

Design Element 7: Situational Awareness Enhancement ("SAE").

Visibility and illumination of the work area is a desirable feature, both for the UW/User/Responder, and the operator, where the concurrent goal may be to view and or document the operations. "Illumination" may be accomplished through a variety of systems, not limited to visible light. Objects may be illuminated by a variety of frequencies including visible and invisible light, audible and inaudible sound, and even magnetism. Complete illumination may require multiple sources operating concurrently to mitigate debilitating "back scatter," i.e. particles suspended in the water [or terrestrially by smoke] that reflect the illumination back to the source. Back scatter impairs depth of vision. Alternative illumination sources such infrared and "sonar," are employable with micro-sized "personal" broadcast/receiving systems that can transmit multiple/alternative spectrums to the remote operator. With a laptop computer, or suitable dedicated device, the "visual" image may be simultaneously viewed and recorded by the remote operator, then redelivered back to the User/Responder, visually enhanced (or converted from non-visual data to visual images) for expanded, real time application using an "in-mask" display, not unlike "Night Vision Goggles". Where an UW/User/Responder might only be able to "see" a few inches in visible light, these personal systems can extend "viewing" range to a hundred feet or more. This benefit is termed "Situational Awareness Enhancement." (SAE) SAE is not limited to visibility, but includes any sensory system used for "Situational Awareness Enhancement," including systems for geo-location.

Said SAE systems require power that is concurrently deliverable through the same umbilical system. Current technology allows the umbilical system to deliver low power DC energy to integrated systems through either wired or optical cables.

Design Element 8: Personal Real-Time Diagnostics ("PRTD").

With multi-format, multi-directional communications, comes the opportunity to independently monitor the vital statistics of the UW/User/Responder, while working in extreme averse conditions. Safety issues, such as core/extremity body temperature are readily measured, with sensors interwoven within the User's undergarments, or on disposable "patches" to their skin. Physical duress and hypothermia can quickly impair a diver's efficiency and create a serious safety issue, before he realizes it himself. So too can hyperthermia, whereby the User/Responder becomes overheated. Surface personal can readily monitor/diagnose the vital statistics of the User/Responder, without interrupting the focus of his attention—to his work. The data from these system is deliverable to/from the diver, via the umbilical system, in either digital or analog format, through wired or optical cables.

Design Element 9: Uninterruptible Power Supply: ["UPS"].

Multi-format communications are not the only accessories that require a power source. For User/Responders working in extremely cold or variant temperatures not only is warmth important, but the ability to regulate it to match the environmental demands is essential for optimize safety and efficiency. Standard dry suit garments are fixed in their range of thermal protection. User/Responders who operate in temperatures that vary greatly between summer and winter, often require multiple garments suitable for each season. This solution is costly. By example: backup User/Responders who wait in sub-freezing surface air have different thermal protection needs from those working under the ice.

When these users move from one environment to another (i.e. from air to under ice, and back to air) their thermal requirements can change drastically, instantly. A single, easily/instantly adjustable, electrically powered undergarment system is a cost effective solution, absent the heavy batteries required to power them. An umbilical system that delivers one or more circuits of uninterruptable, adjustable power to a single "all environment" garment, is a superior, more cost effective, adaptable solution. Similarly delivered, specialized "power tools" for specialized applications including illumination are now possible in lighter weight, "non-battery" variations. Said "tools" include sensory devices for SAE.

Design Element 9: Analog, Digital or Optical:

Data, Communications and Power "wires" are not limited to delivery by "copper." All signals, described herein, encompass all forms, including analog or digital. The term power over fiber or photonic power offers optically delivered power, generated from an electric laser diode that is converted back to electrical power for electronic devices. Source energy can be delivered by optical lines were concerns exist over the safety of wire cables.

The umbilical system is not limited in its methods for delivering energy to devices and applications requiring stable, uninterruptible supplies remotely.

Design Element 10:

Real time monitoring and documentation/recordation of all communication and data streams. The goal of data communications is not limited to real time safety measures and mission decision making. The synchronized, redundant recordation and distribution (both wired and wireless) of video, audio, data (including SAE) is essential to evidence gathering, post mission debriefing, and pre mission training. The instant system design will incorporate (via the connection of additional "Plug & Play" modules) the following, but not limited applications: redundant video recording, audio recording, data collection, both underwater and on the surface. Surface documentation is applicable where surface actions can influence subsurface activities, such as witness statement, or other "hard" evidence. Recordation systems (and said distribution thereof) will include those required for PRTD's and SAE Design Element 11:

Constant Pressure Uninterruptible Gas Supply: ["CPUGS"]. UW/User/Responders require a constant source of breathing gas at variant ambient pressures, independent from the variant high-pressures of the source supply. The system may function automatically, without need of Operator monitoring the User's Depth and adjusting gas pressure being delivered to the User/Responder. This task is accomplishable only by a high-pressure gas delivery system, where both the first and second stages are located at the UW/User/Responder.

Design Element 12:

Constant Pressure Uninterruptible Gas Supply: ["CPUGS"] to deliver the breathing as described in Goal 5, but with a predictably constant degree of gas line pressure. This is accomplishable only by incorporating an Inlet Pressure Regulator ("IPR") that is located between the supply source and the gas delivery line(s) within the umbilical. The great advantage of an IPR: the input pressure as seen by the entire system (downstream from regulator) not only remains stable and constant, it can be tailored to the specific environmental conditions of the operation—regardless of the great and sudden variances in the delivery pressure of the gas source (as occurs with switching of source tanks). The advantage: is a substantial increase in safety factor and a commensurate decrease in system stress and wear.

Design Element 12:

To deliver the option of multiple, instantly selectable lines of breathing gas, each of a different mixture.

Design Element 13:

To deliver the breathing gas described hereinabove through a flexible high-pressure gas line made of any suitable material.

Design Element 14:

To deliver the entire system of gas, data, power and tether, in flexible protective covering against abrasion, that allows for small diameter bend radius. One advantage of employing multiple small diameter lines for each service delivered, is the ability for each line to independently slide and adjust relative to each other. This is essential to achieve small diameter bend radii. One option for keeping the lines together is to bundle them within a single, flexible sheath of woven fibers that bend and adjust as required. Similarly, the inner lines are allowed to "breath", and dissipate moisture as they exit an aquatic environment. A second option is to bundle them in an integrated outer casing, flexible yet able to slide across sharp objects, without wear or tear.

Design Element 15:

To deploy the entire umbilical system, from a deployment system, wherein all applications (including by not limited to), safety tether, communications, situational awareness enhancement, data, diagnostics, power and multiple gas lines all deploy from respective connectors and fasteners from within the hub of the deployment system. These in turn are connected externally (to the deployment system) to their respective source modules via swivels, slip rings or other connective devices.

Design Element 16:

To deliver said breathing gas described hereinabove, in conjunction with an incorporated redundant gas delivery system, where said system may either be attached to the User/Responder, or delivered to User/Responder by a tertiary source, such as another UW/User/Responder or external ("RIT") bottle. Said redundant system may be integrated into the system by the use of a multiple port gas block that allows the selection of one of many alternative gas sources, for delivery to the User/Responder.

Design Element 17:

To deliver said breathing gas described hereinabove, in conjunction with an integrated redundant gas delivery system, whereby said gas may be delivered to a third-party, either through direct connection, or through one of the redundant systems incorporated within the overall umbilical system.

Design Element 18:

To deliver said breathing gas described hereinabove, in conjunction with a redundant gas delivery system, where said redundant gas bottles may refilled or replenished, from the umbilical gas line.

Design Element 19:

To concurrently deliver all applications, as described here, to multiple users.

This invention creates a multiplicity of important, life-saving options for Emergency User/Responders, both terrestrial and sub-aquatic.

PRIOR ART

To the best knowledge of the Inventor, no prior art exists wherein all applications past present and future, are fully integrated into a single, compact, readily transportable "platform" system, nor where a third-party, not originally connected to said surface supply is connectable in situ by a User/Responder, so connected.

U.S. Pat. No. 4,196,307 Marine Umbilical Cable: A unitized marine umbilical cable carrying any number or combination of conventional elements such as hoses and electrical cables.

U.S. Pat. No. 6,390,640 Lighted Mask for Underwater Divers: A lighted mask for underwater divers utilizing a monochromatic blue-green LED light source secured to the mask directing light to the front of the face plate of the mask and having a push button control mounted on the mask for actuating the light source.

U.S. Pat. No. 5,070,437 Electrical Light for Underwater Use: A submersible light includes a generally cylindrical housing body having a closed end and an open end, a light emitting diode and a plurality of batteries are provided at the body and end cap for the open end actuates the light by flexing a lead of the light emitting diode into engagement with the batteries. A clap ring is provided on the outside of the cylindrical housing under which a line can slip for snap-on attachment of the light to a fishing line and the like.

U.S. Pat. No. 6,292,213 Micro Video Camera Usage and Usage Monitoring: Micro video cameras are sufficiently portable, miniature and weather-resistant for hands-free use by an athlete or vacationer who wishes to wear it (or attach it to a base support structure about him or herself) and self-record his or her own amusement, whether indoors or outdoors, underwater or otherwise.

U.S. Pat. No. 5,508,736 Video Signal Processing Apparatus for Production a Composite Signal for Simultaneous Display of Data and Video Information: Video signal processing apparatus comprises means for generating data signals representing the physical status of a video camera with respect to a fixed frame of reference, the physical status being the position, orientation, height, altitude or speed, means for receiving video signals from the said camera and means for combining the said data signals with the said video signals whereby to produce a composite signal by which the data information and the video information contained in the video signals can be displayed simultaneously, and means for transmitting the combined signal to a remote location or means for recording the composite signal.

US20070039617 System and Method for Supplying Breathing Gas to a Diver: The invention concerns a system and a method for supplying breathing gas to a diver. The system is of the open circuit type and comprises a gas source consisting of a pressurized container (1), which is intended to be placed at a distance from the diver and which delivers breathing gas under a high-pressure, a breathing apparatus (4) which is intended to be carried by the diver and a flexible tube (3), which connects the gas source With the breathing apparatus. The flexible tube is of the high-pressure type, the gas is conducted through the flexible tube under a pressure, which is essentially equal to the pressure delivered from the gas source, and the gas source is arranged to be able to deliver breathing gas at a pressure, which exceeds approx. 30 bars.

WO 1992005999 Improvements In Diving Apparatus And Methods Of Diving; An underwater deployment and storage apparatus for an umbilical, for a diver as example, has a reel with spaced flanges to contain an umbilical services assembly wound around a hub (7*a*) of the reel, a rotary union mounted in the hub having a fixed assembly about which the hub rotates, said assembly receiving services and feeding same to a rotatable assembly connected with the hub and coupling said services to one end of the umbilical, first drive means to rotate the reel, second drive means associated with a fairlead through which the umbilical is extracted from or rewound onto the reel, both said drive means being arranged to exert and maintain attractive or a drag force on the run of umbilical extending between the fairlead and reel.

US20100288801 Container Holder With Fasteners: One design embodiment of a holder for a container which may be comprised of a connector band that connects to holder band eye brackets in which strap bolts that are held in place by strap bolt heads and strap bolt nuts retain fastener straps that connect through release buckles to fasteners. The container may be attached to the user or a host device using a variety of easily configurable methods, as required by the intended use, including but no limited to the use of fasteners with integrated strap adjusters or fasteners that attach the holder to belts, straps or webbing, by the use of which include direct attachment points to integrated release buckles. The design embodiment allows easy attachment, use and deployment of containers in a variety of environmental conditions and situational awareness uses, including but not limited to the carrying of gas supplies for underwater divers.

WO 2013064962 A2 Multiple Port Distribution Manifold: A mountable Multiple Port Distribution Manifold consisting of a knob, connected to a hollow, rotate-able Shaft that mounts within the Manifold. By rotating the Knob/Shaft, the side hole of the Knob/Shaft assembly may selectively intersect with multiple ports within the Manifold. Said assembly also provides of an "off" position, where no Shaft/Manifold intersection allows port to port connection.

U.S. Pat. No. 4,138,178 A composite diver's umbilical including concentric hoses for breathing gas, heating fluid supply and return, electrical conductors, and a strength member, and cooperating separable connectors for effecting end to end joining of segments of the umbilical. The connectors are characterized by cooperating nipple and receptacle members having coaxial, arcuate passageways, and cooperating pin and socket electrical connectors.

U.S. Pat. No. 3,924,619 Method and apparatus entailing an underwater breathing system in which (1) a continuously flowing supply of reconditioned gas is supplied to a diver through flexible umbilical means extending from an underwater enclosure, in which (2) a return tank means receives gas from the umbilical means and a supply tank means supplies reconditioned gas to the umbilical means, in which (3) both the return tank means and supply tank means are located remote from the diver, and (4) in which a surface located source of breathable gas is continuously available.

JP3568268B2 A method for supply of air to diver operating an underwater excavating machine and supplying buoyance to said machine.

CONCLUSION

In conclusion, insofar as the Inventor is aware, no device or system formerly developed provides as simple, elegant and reliable design solution for the multiplicity of safety related needs of both (SCUBA and SCBA) User/Responders, operating in adverse environments that require an uninterruptible, multiply source, redundant, breathing gas supply, safety tether, monitoring, documenting, distributing multidirectional, multi-format data and communications, including, but not limited to personal diagnostics, situational awareness; plus independent power distribution, with integrated systems for gas redundancy and replenishment "in situ" and delivery of surface supplied breathing gas, to non-integrated third parties.

SUMMARY

The invention is a quantum improvement in the design of systems for cost effective umbilical delivery of a safety, communications, personal/situational diagnostics, power distribution and breathing gas, uninterruptedly for extended/unlimited periods of time, irrespective of the gas source pressure. The invention provides a simple, compact, elegant, reliable, fully integrated and easily transportable design solution for the multiplicity of safety related needs of both (SCUBA and SCBA) User/Responders, operating in adverse environments.

BRIEF DESCRIPTION OF THE DRAWING—SYSTEM DIAGRAM

FIG. 1 is a representation of the integrate umbilical delivery system.

DETAILED DESCRIPTION OF THE DRAWING—SYSTEM DIAGRAM

The system incorporates numerous system components. In reference to FIG. 1, they are:

System Group #1:

Breathing Gas sources may include a single "mix" (of Oxygen with other gasses), or multiple alternative mixes, each requiring their own independent supply source. A "Source Gas" may include one or more tanks, or a compressor, capable of feeding an uninterrupted supply of gas to an Inlet Pressure Regulator. The IPR allows the Operator to selectively determine the operating "High" pressure level of the entire downstream system, for each gas source.

System Group #2

In the event of multiple mixes, coming from multiple sources, a high-pressure, multi-gas selector manifold may be used to select the appropriate gas to remain under sufficient pressure for the first and second stage regulators, located at the User/Responder's end, to operate nominally. If this selector is located at the User/Responder end of the system, (See System Group 7) this System Group may be eliminated.

System Group #3

This group is comprised of a plurality of modules, each supplying, acquiring, monitoring, distributing and recording a different set of data and communications. Also see System Group #13. The modules suggested below are offered only by way of example, without any limitation as to the types of systems that may be included within this System Group:

Audio Communications: Operators a User/Responders will communicate audibly. In the event of Multiple Operators and User/Responders, all will be able to communicate with each other. All communications will be distributable and recordable, with or without synchronization with Video communications. All suggested systems include all possible perspectives: above, at and below the Operator and or User Level.

Situational Awareness—"Video Communications": The term "video" is used generically. It encompasses the use of any system for observing, analyzing, distributing and recording the situational environment of the User/Responder. This includes non-visual sensors (including but not limited to toxicity, temperature, environmental current, electrostatic, electromagnetic, radioactivity, geo-location) that convert their respective data to visual media) User-mounted Systems (see System Group 12) may include traditional video cameras, with integrated illumination. It may include Infrared sensors. It may include multi-frequency sonar systems, for high resolution visualization for hundreds of feet distant, in an environment that offers zero visibility to the unaided human eye. The User mounted systems will deliver their respective data "up" the umbilical line to their respective devices, for monitory, analysis, recordation, and if required, conversion to visible light frequencies. The converted signals may then be sent back "down" the umbilical, to a "in-mask" screen for User application. Source material for user application, is not limited to that generated by the User-mounted sensors. It may also include audio/video/data (live or pre-recorded) generated at the Operator level. All suggested systems include all possible perspectives: above, at and below the Operator and or User Level.

Situational Awareness—"Personal Diagnostics": This term is used generically, to include all forms of data collection and transmittal, relating to the physical well-being of the User/Responder. Example data includes, core body temperature, extremity temperature, heart rate, breathing rate, gas rate consumption, or any other "vital statistics" essential for analyzing the health of the User/Responder, and to predict/avoid any emergency that could be precipitated by an impaired User. Said data would be sent "up" the umbilical for monitoring and documentation by operator personnel. All suggested systems include all possible perspectives: above, at and below the Operator and or User Level.

System Group #4

This group of modules may include power circuits of any type, including but not limited to electric, pneumatic and hydraulic. (See System Group #6)

Electric: Moderately powered electric tools, instruments and accessories, operating with 12 VDC are commonplace. The same tools, instruments and accessories ("Devices"), may be powered by specially designed "constant current" low voltage, GFS protected DC circuits. Said devices, by way of example only, may include powered drills, drivers and cutting tools. They may include outboard electronic devices for analyzing systems, environments, locations and structures for integrity. They may also include circuits to supply current for electrically heated undergarments, in multiple zones, for increased user comfort and dexterity.

Pneumatic: With the option of multiple independent, high-pressure gas lines, comes the option for powering pneumatic tools. High-pressure ("HP") surface supplied gas may enervate both HP and low-pressure ("LP") pneumatic tools, (with the insertion of a small step down, regulator between the tool and the HP line.)

Hydraulic: With the option of multiple independent, high-pressure gas lines—comes the option for powering tools and accessories through hydraulics.

System Group #5

Deployment System: is any suitable system for mating a multiplicity lines, (gas, hydraulic, communications, data) with their constituent lines, within the overall umbilical, such that they all operational upon connection, irrespective of whether and or how much of the total umbilical lines is deployed. If the deployment system is rotational, the use of swivels, and slip rings may be incorporated, as required by their constituent sources (gas, hydraulic, data or communications)

System Group #6

Power Uses: This group encompasses the Devices (tools, instruments and accessories) that are powered by the Sources described in System Group #4. Said Devices may be powered by electrical current, or pneumatics, hydraulics or other suitable power sources.

System Group #7

In the event of multiple mixes, coming from multiple sources, a high-pressure, multi-gas selector manifold is required to select the appropriate gas to remain under sufficient pressure for the first and second stage regulators, located at the User/Responder's end, to operate nominally. If this selector is located at this end of the system, System Group 2 may (but is not required to) be eliminated.

System Group #8

Exposure Suit and Buoyancy Control: User/Responders who operate at depth, require protection from the environment, and the ability to control their depth. Environmental protection is commonly in the form of a "dry suit" that encapsulates and protects the User from the temperature and toxicity of the environment. Buoyance Control is accomplished by the use of a User inflatable bladder that can be adjusted to create "neutral buoyancy" at any depth. Traditionally, said gas delivery port may also deliver emergency breathing gas to a Rescuee/Third-party User/Responder. Each traditional application requires the insertion of additional air with increased depth, and the expulsion of that air, as the User ascends. Traditionally, the servicing of these devices comes from the tank on the User's back. The instant umbilical system, creates no need for change of this time tested method. The umbilical system, however, offers an alternative method, that is supplied directly from the umbilical, through the first stage regulator that accepts the HP breathing gas, that it delivers the User/Responder. If "pre gas block" first stage regulator (see System Group #10) includes additional LP gas OUT ports, these are connectable directly to the Exposure Suit, BCD and Third-party User/Responder. This arrangement allows Redundant tanks #1 and #3 to serve their primary function, only. (See System Group 11)

System Group #9

Multiple Port Low-pressure Gas Block: Delivery to the User, of any one from of a choice of alternative gas sources, requires a selector device or manifold. The instant invention offers a select of sources. First is the "main" source, delivered from the System Group #1, through System Group #5, (which may or may not include System Groups #2 & #7). In the event System Group #1 is interrupted, the User may select gas from either the first ("back") or second ("front") redundant tanks (See System Group #11), or an alternative "external" source that may be provided by another User or delivery method, i.e., tanks rotate-ably connected or a "buddy hose" from another User. (See System Group #12)

System Group #10

Each gas source, connected to the Multiple Port Gas Block, must be "Low-pressure." This means the HP gas pressure, within the umbilical or alternate gas source, has been reduced to the Low-pressure required by the second stage regulator before it enters the Gas Block. This requirement is set by the second stage regulator, into which the Gas Block will directly feed, via a flexible low-pressure hose. Traditionally, this second stage regulator is located within the User's full face mask. Alternatively, it may be independent of the User's mask, if full User/Responder encapsulation was not operationally required.

System Group #11.

An umbilical system, requires back up redundancy, in the event of gas delivery interruption. The first redundancy is provided by the "Back Tank" as traditionally worn by User/Responders. In the event of first redundancy failure or depletion, the Gas Block (System Group #9) may select the "Front Tank" for redundancy.

The terms "Front Tank" and "Back Tank" are used herein, generically to identify any two tank contained sources, of any size, attached anywhere on the User/Respondent's body.

System Group #12

An External Gas Source, includes any/every possible source of gas, whether it be delivered from additional tanks, that are rotate-ably connected, or a "buddy" system comprised of gas source delivered by hose connection, from another User/Respondent, (irrespective of their source of breathing gas: self-contained or surface supplied), or an additional surface gas supply, with an integrated first stage regulator, that is directly connectable to the gas block, per its low-pressure requirement.

System Group #13

As the reciprocal end to Source System Groups, Nos. 1, 3, 4 & 6 the User will generate the images, personal, situational and sensory data from the associated devices located at the User's end. The User will receive the breathing gas (through the second stage regulator) and tether for life sustenance and safety. The User will receive the power supply circuits to enervate all devices, tools and accessories, needed by User's mission.

The following information and diagram hereinabove, represents the general design characteristics of the "Umbilical Support System for Life, Safety, Data Delivery/Acquisition, Power, Situational Awareness and Communications for Persons in Adverse Environments"

It does not represent the manufacturing details of the final production product. Component shapes, sizes and fit will change in response to the requirements of various applications and evolving technologies and materials.

Said Umbilical Support System consists one or more Operator selectable high-pressure gas sources, that one or mixers, which source one or more Inlet Pressure Regulators, which deliver a constant, Operator selectable high-pressure gas, independent of the variant pressures of each supply gas source.

Said selectable high-pressure gas sources connect to a deployment system, that may concurrently deliver multiple gas mixtures, through high-pressure gas lines, for user selection, concurrently with other sources for communications, personal diagnostics, situational awareness enhancement, power distribution for accessory devices, and safety tether, all retained within a flexible covering, and easily deployed from a deployment system. Said non-gas-related delivery systems operate by a plurality of methods including but not limited to analog, digital, electrical wire, optical cables.

At the User end, said system deploys said umbilical lines to the User/Responder, independently grouped within a flexible, protective covering. Said umbilical communicates with the User/Responder, as does each interior line (3) within the covering to independently communicate with each respective component connectors, as required by their respective function. Said tether terminates with a fastener, connected to the harness of the User/Responder. Said power distribution lines communicate with each accessory device requiring power. Said multidirectional, multi-format communication lines communicate with reciprocal lines arriving from their associated devices attached to the User/Responder. Said diagnostic lines communicate with reciprocal User/Responder sensory lines.

At the Operator end, each gas, data and communications line within said deployment system independently communicates with each respective component connector, as dictated by their respective function. Said tether terminates with a deployment system. Said power distribution lines communicate with each power source, whether electrical, pneumatic or hydraulic. Said multidirectional, multi-format communication and data lines communicate with each respective component connectors, as dictated by their source function and the devices and or instruments to which they must be connected.

At the User end, said constant high-pressure gas line(s), communicate either directly with a first stage regulator, which may communicate with a multi-port gas manifold, where in the User/Responder may also select from a plurality of alternative post-first-stage/redundant gas sources, either carried by the User/Responder or supplied tertiary from an external source such as back up RIT bottle, "dive buddy" or alternative surface supplied source. Said gas block communicates with User/Responder's second stage regulator. Said redundant tanks may also communicate with User/Respondent's Exposure Suit, BCD and or Third-party User/Responder. Said HP umbilical gas lines, may also communicate with said redundant tanks, to replenish them, "in situ."

The invention further allows for the "in situ" replenishment of high-pressure gas into both, the first redundant "back" tank, or the second redundant "front" tank. This is accomplished simply by the Operator, raising the internal High-pressure of the Surface supply to any PSI that his higher than the internal pressures of the redundant tanks. If incorporated within the system, this will automatically open a Gas IN Check Valve located within an integrated Tank valve/first stage regulator on each tank, to replenish said redundant tanks.

At the User end, said Power lines communicate with their respected devices, tools and accessories, for application by the User/Respondent.

The invention may be constructed of any suitable materials, natural or synthetic, that is sufficiently strong to withstand the internal gas pressures, be impervious to abrasion, corrosion and all other customary "wear and tear" factors, commonly experienced by systems and devices of this nature.

I claim:

1. A life-support system comprising a single integrated umbilical, a source-end service section, an integrated deployment section, and a user-end service section, wherein said source-end service section comprises:

at least one high-pressure gas source which communicates a high-pressure gas through a high-pressure hose to said integrated deployment section; and at least one bi-directional data communications source which communicates data communications through a line to said integrated deployment section;

wherein said integrated deployment section combines and deploys source-end services within a single, flexible, integrated umbilical, comprising:

an independent tether;

at least one independent power line;

at least one independent high-pressure gas hose;

at least one independent line for bidirectional data communication; and a flexible protective covering;

wherein said integrated umbilical communicates with said user-end service section, comprising:

a high pressure first-stage pressure reducing regulator which communicates with at least one user-end low-pressure device;

at least one bidirectional data communication device; and at least one second stage pressure reducing regulator wherein said user-end service section is in communication with said independent tether.

2. The life-support system of claim 1, wherein said source-end service section high pressure gas source communicates with at least one high pressure inlet regulator, which communicates high pressure gas through said high-pressure hose to said integrated deployment section, which communicates with said user-end service section.

3. The life-support system of claim 1, wherein the source-end service section is further comprised of at least one power source which communicates with said integrated deployment section, which communicates with at least one independent power line within said umbilical, which communicates with at least one user-end service section power device.

4. The life-support system of claim 1, where said user-end service section comprises a high-pressure gas selector which communicates with a user-end service section high-pressure gas hose which communicates with said at least one high pressure first-stage reducing regulator which communicates with said at least one user-end low-pressure device.

5. The life-support system of claim 1, wherein said integrated deployment section high-pressure gas hose is made of flexible material of predetermined diameter, capable of retaining internal pressures equal to or greater than said high-pressure gas source.

6. The life-support system of claim 1, wherein said independent tether independently communicates said user-end service section to said deployment section.

7. The life-support system of claim 1, wherein the least one integrated deployment section high-pressure gas hose, the at least one integrated deployment section bidirectional data communication line, said at least one independent power line and said independent tether are combined into a single longitudinal group for deployment and storage.

* * * * *